United States Patent [19]

Nestler et al.

[11] Patent Number: 4,579,331

[45] Date of Patent: Apr. 1, 1986

[54] METHOD AND APPARATUS FOR GRIPPING AND SEPARATING SHEETS

[75] Inventors: Dietmar Nestler; Bernd Litzkow, both of Cottbus, German Democratic Rep.

[73] Assignee: VEB Textil- und Konfektionsbetrieb, Cottbus, German Democratic Rep.

[21] Appl. No.: 563,908

[22] Filed: Dec. 21, 1983

[30] Foreign Application Priority Data

Jan. 10, 1983 [DD] German Democratic Rep. ... 247124
Jan. 10, 1983 [DD] German Democratic Rep. ... 247125
Jan. 10, 1983 [DD] German Democratic Rep. ... 247126

[51] Int. Cl.[4] ..... B65H 3/22; B65H 5/14

[52] U.S. Cl. ..... 271/18.3; 271/268; 294/61

[58] Field of Search ..... 271/18.3, 141, 168, 271/119, 252, 267, 268, 19; 221/210, 213, 215, 216; 294/61

[56] References Cited

U.S. PATENT DOCUMENTS

| | | | |
|---|---|---|---|
| 3,386,763 | 6/1968 | Ottaway et al. | 271/18.3 X |
| 3,588,091 | 6/1971 | Stone, III et al. | 271/19 |
| 3,747,919 | 7/1973 | Stewart et al. | 271/18.3 X |
| 4,015,872 | 4/1977 | Loznak et al. | 294/61 |
| 4,437,655 | 3/1984 | Bijttebier et al. | 271/18.3 X |
| 4,444,384 | 4/1984 | Keeton | 271/18.3 |

FOREIGN PATENT DOCUMENTS 2502325 7/1975 Fed. Rep. of Germany ..... 271/18.3

*Primary Examiner*—Bruce H. Stoner, Jr.
*Assistant Examiner*—Lawrence J. Goffney, Jr.
*Attorney, Agent, or Firm*—Jordan and Hamburg

[57] ABSTRACT

A method and apparatus for gripping lifting and transporting a sheet, especially a textile sheet, from a stack of sheets. The apparatus has a plurality of substantially vertically oriented gripping mounted under and depending downward from a substantially horizontal holder. Each device has at its downward terminal end a pair of clamping jaws. Each clamping jaw has a plurality of pointed tip members depending downwardly from its edge adjacent the other jaw. A plurality of spaced-apart finger grippers are rotatably disposable to a position beneath the clamping jaws. Each gripping device is preferably arranged with respect to another so that its downward terminal end is in a different horizontal plane from each other juxtaposed device. The method utilizes the apparatus to perform the steps of positioning the gripping device over the uppermost sheet of a stack, opening, lowering and closing the clamping jaws with the pointed tips piercing the upper surface structure of the uppermost sheet, lifting the sheet away from the stack with the sheet undulating according to the arrangement of the clamping jaws, and rotating the finger grippers to a working position at the underside of the sheet to further support it.

23 Claims, 3 Drawing Figures

METHOD AND APPARATUS FOR GRIPPING AND SEPARATING SHEETS

BACKGROUND OF THE INVENTION

The invention is particularly used for the gripping of textile sheets, but can also be used for other sheet materials which allow the penetration or pointed tips into the surface structure, the tips serving for the removal of the respective top sheet or layer from the stack, as well as for the secure holding of the sheet during transport within the production process.

Methods and apparatus for the separating of textile sheets from a stack are known, in which needle-like gripping devices penetrate the material, grip the top material layer and remove it. Various constructions of needle gripping devices have been developed. There are, for example, apparatus, which grip the top layer with needle-like elements, pointing in an obliquely outward direction, penetrating the material, and with the material being subsequently stretched because of the expansion of these elements. The danger of damage to the material is considerable, since in order to securely grip the material layer, sufficient force has to be present to spread the needles.

Another method introduces needles, directed opposite to one another, into the material in such a way that they cross over inside the material, thus allowing a punctiform gripping of the top material layer. These types of apparatus require high production and monitoring costs, since their functioning depends on the accuracy of the depth of penetration of the needles, as compared to the strength or thickness of the material.

In an additional group of methods, the top layer of a stack of textile sheets is lifted, with gripping devices pushing the material into a fold by their gripping movements, and in this manner gripping the material. Apparatus configurations are known, which differ from each other in the way by which they push the material together to a fold. The folding, which is typical for this method, has the disadvantage that the displacement of the top layer of material which is, necessary for the fold formation, requires the overcoming of frictional forces along the mating surfaces of the material layer to be gripped, and the material layer underneath it. An improvement of the attachment between the contoured bottom sides of the gripping device and the upper side of the top material layer, by increasing the attachment power of the gripping apparatus, is successful only in the case of smooth materials, however, this increases the probability that several layers will be gripped at the same time.

SUMMARY OF THE INVENTION

It is the object of the present invention to develop a method and a gripping apparatus, with which, at low cost, stacks of sheets particularly textile sheets, can be securely separated, eliminating permanent monitoring. The use of the invention is coordinated into the particular technological process, and is controlled by remote control.

It is another object and the technical task of the invention to develop a method and a gripping apparatus with which in particular textile sheets, but also other sheet materials as well, having a surface structure which allows the penetration of pointed tips, can be securely gripped and held, while reducing the adhesive effect between two layers of textile sheets or other materials, and with gradual positioning of the gripping devices used for the method, with the objective of reducing monitoring expenditures for the precise attachment of the gripping devices. The gripping of several layers at the same time is avoided, with the gripping device piercing the surface structure of the top layer or a stack of sheets, without completely penetrating it.

These and other objects and advantages of the present invention will become evident from the description which follows.

BRIEF DESCRIPTION OF THE INVENTION

The objects are accomplished in the present invention by clamping jaws, arranged on the gripping device, and divided and spaced apart, and having rows of pointed tips, located parallel to one another at the edges of an aperture jaws which jaws, when open, attach via their planar bottom side to the upper surface of the textile sheet to be gripped, with the pointed tips, which are located perpendicular to the planar bottom side, piercing the upper surface structure. The depth of penetration depends on the length of the pointed tips and is additionally limited by the large support area of the planar bottom side of the clamping jaw, as compared to the points themselves. Having been attached, the clamping jaws are closed. The minimal aperture prior to the closing, assures that only a small portion of the upper surface of material structure is gripped between the points subsequent to the closure and held. The gripping devices are preferably fastened to a holder in a row, or a plurality of parallel rows in such a way that the bottom sides, prior to the attachment of the clamping jaws, are spaced at different distances from the upper side of the top layer of textile sheets. The holder with the gripping device is lowered so that all clamping jaws, elastically or spring mounted in the gripping device, lie against the upper side of the textile sheet. With the lifting of the holder, the seized textile sheet is lifted, according to the set distance, so that preferably every other gripping device still holds the textile sheet down, while the intermediary gripping device lifts the textile sheet. Thus, the adhesive effect between adjacent sheets is reduced. This is an advantage of the invention. The elastically mounted clamping jaws enable position monitoring of the holder, in relationship to the respective top layer of textile sheets in the stack, in discretely staggered steps. Following the lifting, in support of the transport of the textile sheet, and when required, and if the gripping devices attach at an edge of the textile sheet, additional finger grippers position themselves to the planar bottom side of the clamping jaw, holding the intermediary textile sheet. When separating stacks, prior to the first lifting stage or process, needles are stuck through the stack from below, with the point of the needles piercing the top layer immediately behind the attached gripping devices, securing the stack in its position. Having lifted the respective top layer above the needle points, a lifting track is guided between the top layer and the subsequent layer, separating both layers from each other, and covering the end of the needle points when in its end position. The seized textile sheet can now be transported from above the lifting track. The gripping device with electric, hydraulic or pneumatic actuating means, necessary for the execution of the method, includes in the present invention a conical base, fastened to a piston rod, divided and forming two expandable clamping jaws. The slit lower edges of the jaws each have a row of points, i.e.; tips, of preferably semipyramid shape, the rows being located parallel to one another and with pointed tips perpendicular to the planar bottom side of the base. The conical base with the piston rod is slidingly arranged in a housing or sleeve, with an equally conical opening, the sleeve serving as a piston guide. The base with the piston guide is axially movable and elastically mounted in a gripper housing. A finger gripper, actuated by the same means as the piston rod and mounted onto the gripping device, is rotatably arranged, so that it lies against the bottom side of the clamping jaw, when it is in working position. The open clamping jaws attach with their planar bottom sides onto the upper side of the textile sheet to be seized. The points or tips pierce the thread structure perpendicularly, without penetrating the layer to be gripped. After the clamping jaws have been closed, the textile sheet can be lifted by the thus seized threads or fibers. When gripping the textile sheet at the edges of the stack, finger grippers can be held in the working position against the bottom side of the clamping device, in order to increase the holding effect, as well as holding the material edge. By the movable arrangement of the clamping jaws in the gripper housing, the requirements for monitoring of the positioning of the gripping device for the attachment onto the textile sheet can be reduced.

In summary, the present invention entails a method and gripping apparatus for gripping and separating sheets, expecially textile sheets.

The method and apparatus is used for the separation of sheets, especially of textile sheets, and serves particularly for the lifting of the top layer or sheet from a stack, as well as the secure holding of a textile sheet during transport.

The method and gripping apparatus allow the separation of sheets, especially of textile sheets, from a stack, as well as their secure gripping in an all-automatic process. Points or tips are arranged on the clamping jaws of the gripping device, which pointed tips pierce the top material layer of a stack, and grip the layer when the clamping jaws are closed. By a different arrangement or spacing of the gripping devices relative to the stack surface, there is an undulated lifting of the top layer from the stack. Preferably, at every other gripping device of a row or array of such devices, needles are stuck through the stack from below, securing an additional positioning of the stack.

By using additional finger grippers, the lifted textile sheet can be held during transport. The present method and gripping devices apparatus is particularly useful in the clothing industry, for the automation of production processes.

Following is a reference glossary of elements and structural members as employed in the present invention.

GLOSSARY

1. Textile sheet
2. Gripping device
3. Holder
4. Clamping jaws
5. Finger gripper
6. Needle
7. Needle point
8. Lifting track
9. Gripper housing
10. Connection piece
11. Piston guide
12. Piston rod
13. Working piston
14. Counter spring
15. Base
16. Expanding spring
17. Points
18. Clamp
19. Pistons
20. Toothed rack
21. Gear wheel
22. Bushing The invention accordingly consists in the method and apparatus for gripping and separating sheets as described supra, and as will be described infra and shown in the drawings, and as recited in the appended claims.

BRIEF DESCRIPTION OF THE DRAWINGS

The invention will be illustrated by means of the drawings, in which.

DETAILED DESCRIPTION OF THE PREFERRED EMBODIMENTS

Figure 1:
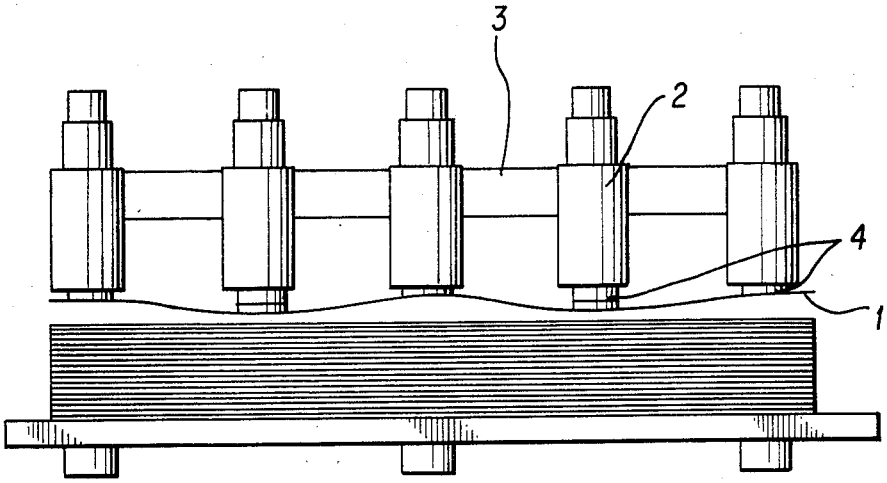
FIG. 1 shows gripping devices arranged in a row with a seized material layer.
Figure 2:
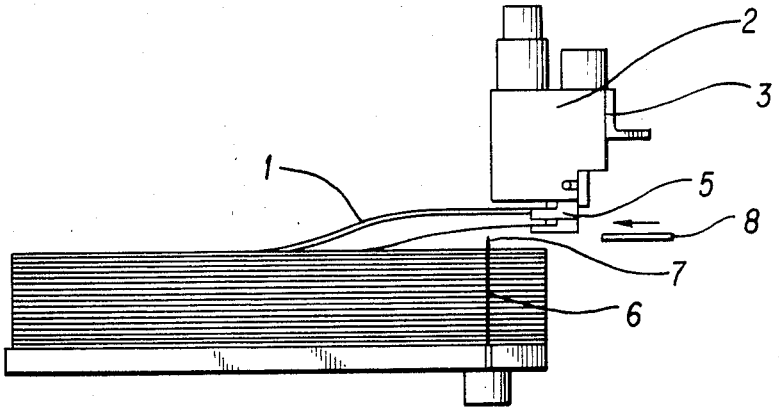
FIG. 2 shows a functional arrangement of operating points disposed so as to carry out the method of the invention.
Figure 3:
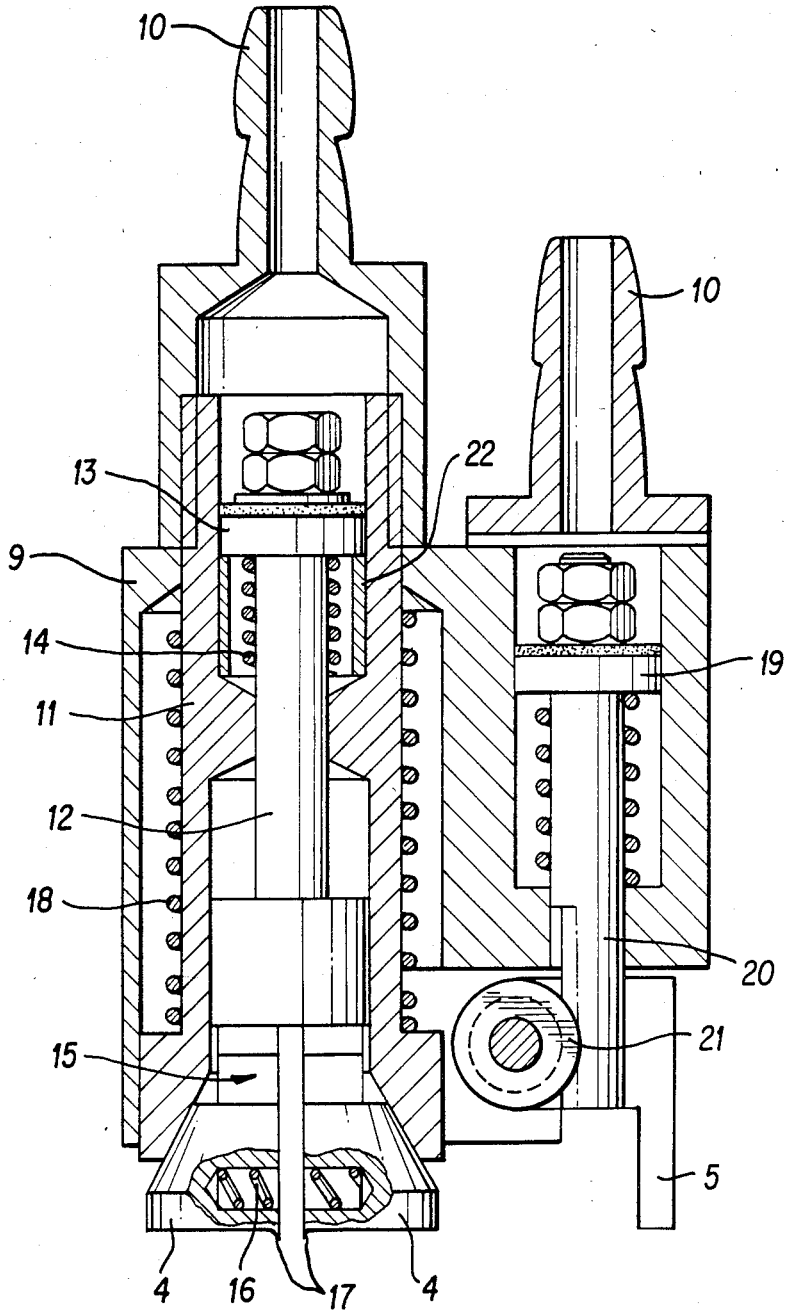
FIG. 3 shows a gripping device in cross-section.

Referring now to the drawings, a number of gripping devices 2, corresponding to the size of a textile sheet 1, are fastened to one or several holders 3, so that the clamping jaws 4, of the gripping devices 2, which are planar and divided on the bottom side, have at least two different distances to the upper side of the textile sheet 1 to be seized. By lowering the holder 3, the clamping jaws 4 are attached to the top layer of the stacked textile sheet 1, with the elastic mounting of the clamping jaws 4 in the gripping devices 2 equalizing the different distances to the upper side of the top layer. Prior to attaching, the clamping jaws 4 open, with a small, adjustable slit being formed between them, corresponding to the strength or thickness, and the structure of the textile sheet 1. When attaching the clamping jaws 4, points or tips, located in rows parallel to one another at the edges of the aperture, and perpendicular to the planar bottom side of the clamping jaw 4, pierce the upper surface of the textile sheet 1. Because of their small dimensions, as compared to the thickness of the textile sheet 1, and because of the limited depth of penetration, due to the planar bottom side of the clamping jaw 4, serving as a contact point, a total penetration of the top material layer is prevented. When attached onto the material layer, the clamping jaws 4 are now closed and the fiber components located between the row of points or tips is held. When lifting the holder 3, the clamping jaws 4 spring out of the gripping devices 2 with different height. Because of the different height of the adjacent individual clamping jaws 4 to the upper surface of the top layer, the top layer gripped by the clamping jaws 4 with the largest height are the first to be lifted, while the other clamping jaws 4 still serve as clamps and are lifted later. This lifting of the top material layer, being laterally different at various points, reduces the adhesion of the layers to one another in a favorable and advantageous fashion, as compared to a simultaneous lifting. If the gripping devices 2, which seize the textile sheets 1, are arranged at the edges of the sheets, additional digital grippers 5, arranged in a perpendicular fashion relative to the gripping devices 2 when not in operation, can additionally hold the edges of the textile sheets 1. Having lifted the textile sheet 1, the finger gripper 5 is rotated around a fulcrum and attaches itself onto the bottom side of the clamping jaws 4, with the seized material edge being clamped. When separating stacks, prior to the initial lifting process with attached clamping jaws 4, needles 6, serving as clamps, are stuck through the stack of textile sheets 1, preferably at every other gripping device 2, and immediately behind the clamping jaws 4, starting with the contact surface of the stack. The needle points 7 pierce the upper surface of the top stack layer. The needles 6 position the stack in its position. Following the described lifting of the top layer of the stack by gripping devices 2 above the height of the needle points 7, a lifting track 8 is moved immediately above the needle points 7 and parallel to the upper side of the stack, and between the already lifted layer and the subsequent layer, and from the edge towards the middle of the stack, covering the needle points 7 in its final or end position. Following the transport of the textile sheet 1, the lifting track 8 moves into a starting position outside the stack.

In the gripping device 2, and necessary for the execution of the method, a working piston 13, connected to a piston rod 12, is provided in a gripper housing 9, with two connection pieces 10 for compressed air, and a piston guide 11, the working piston being held in its uppermost position by a counter spring 14. A conical base 15, fastened to the other end of the piston rod 12, is divided and forms two clamping jaws 4, which can be expanded by an expanding spring 16, and the cone-shaped shell surface which lie against the surface of a hollow cone on the bottom side of the piston guide 11. At the aperture edges of the clamping jaws 4, a row of points or tips 17 with a semi-pyramid shape have been arranged parallel to one another and perpendicular to the bottom side of the base 15. The piston guide 11 is axially movable within the gripper housing 9, and is held in its lowest position by a clamping spring 18.

A second piston 19, located in the gripper housing 9, is connected with a toothed rack and engages with a gear wheel 21, which forms the unit with a finger gripper 5. Prior to attaching the gripping device 2 onto the textile sheet 1 to be seized, the working piston 13 is moved into the working position by compressed air. The base 15, connected with the working piston 13, slides along the conical surface, is pushed outwardly by the expanding spring 16, whereafter the two clamping jaws 4 open. The gripping device 2 is lowered onto the textile sheet 1, with base 15 attaching with constant force, due to the elastic spring mounting. During the attachment, the points or tips 17 pierce the surface of the textile structure, without completely penetrating the entire thickness the textile sheet 1. Having attached the gripping device 2, the pressure system is ventilated, and the working piston 13 is then moved by the counter spring 14 into a resting position. The clamping jaws 4 are closed, with fibers from the upper surface of the textile sheet 1 being clamped between the row of points or tips 17. By lifting the gripping device 2, the top sheet or layer is removed from the stack.

If the gripping device 2 for the seizure of the top layer is located at the edge of the stack, the finger gripper 5 is pushed by the rack and pinion drive against the bottom side of the clamping jaw 4, by actuating the second piston 19 by compressed air, thus holding the material.

By exchanging the bushing 22 for a bushing with a different length dimension, the distance between base 15 and the working piston 13 changes, and thus the distance of the clamping jaws 4 relative to one another is changed, allowing adjustment possibilities for the gripping of textile sheets of varying or different dimensions (thickness).

It thus will be seen that there is provided a method and apparatus for gripping and separating sheets, especially textile sheets, which attains the various objects of the invention, and which is well adapted for the conditions of practical use. As numerous alternatives within the scope of the present invention, besides those alternatives, variations, modifications and embodiments contemplated supra and as shown in the drawings, will occur to those skilled in the art, it will be understood that the present invention extends fully to all such, and other alternatives and equivalents within the scope of the present invention, and is to be limited only by the recitations in the appended claims, and functional and structural equivalents thereof.

We claim:

1. A method for gripping a top flat sheet of material from the top of a stack of a plurality of flat sheets of material, separating said top flat sheet of material from said stack, and transporting said top flat sheet of material away from said stack, said top flat sheet of material having an upper surface structure which permits the piercing of said upper surface structure by pointed tip members, which comprises (a) providing a plurality of spaced-apart gripping devices, said gripping devices being juxtaposed and substantially vertically oriented, and being mounted and dependent from a vertically movable substantially horizontal holder, said holder being capable of being positioned directly above said stack, so that the lower terminal end of each of said gripping devices is contiguous with said upper surface structure;

(b) providing a pair of opposed built-in clamping jaws at the lower terminal end of each of said gripping devices, said clamping jaws being displaceable and movable towards or away from each other, and a plurality of spaced-apart finger grippers adjacent the edges of the top flat sheet of material, said finger grippers being rotatably disposable adjacent the clamping jaws;

(c) providing a plurality of rows of pointed tip members, each row of pointed tip members being dependent from one of said clamping jaws, each pair of rows of pointed tip members being arranged in parallel and disposed at and along the edges of an aperture between the pair of clamping jaws from which they depend, each of said pointed tip members extending substantially perpendicularly downwards from the bottom of its respective clamping jaw;

(d) providing actuation means for the manipulation of said gripping devices;

(e) positioning said holder directly above said stack;

(f) moving the clamping jaws of each of said gripping devices away from each other, so that said clamping jaws are opened;

(g) moving said holder downwards, so that said clamping jaws attach onto said top flat sheet of material, with said pointed tip members piercing said upper surface structure without completely penetrating through the structure, or through said top flat sheet of material;

(h) closing said clamping jaws subsequent to the attachment of (g), the closing path and the distance of movement of said clamping jaws being small relative to the dimensions of said upper surface structure, so that said pointed tip members seize and hold only a portion of said top flat sheet of material;

(i) subsequently displacing said holder upwards, so that said top flat sheet of material is lifted off from the top of said stack, with said top flat sheet of material being held by said gripping devices;

(j) rotating said finger grippers to the underside of said top flat sheet of material for additional support of said top flat sheet.

2. The method of claim 1 in which the top flat sheet of material is a textile sheet.

3. The method of claim 1 in which the gripping devices are fastened onto the holder at varying vertical elevations, so that the gripping devices are at varying and different distances from the upper surface structure of the top flat sheet of material, the varying and different distances being equalized in step (g), because of an elastic or spring mounting of each of the pairs of clamping jaws into the respective gripping device, so that in step (i), the clamping jaws lift the top flat sheet of material in such a way that only a portion of the gripping devices initially remove the top flat sheet of material from the stack, and the balance of the gripping devices hold the sheet down, with the clamping jaws in the balance of the gripping devices being not as yet completely opened.

4. The method of claim 3 in which the gripping devices alternate between a high and a low vertical elevation, so that the top flat sheet of material assumes an undulating form during movement and lifting from the top of the stack.

5. The method of claim 3 in which the positioning of the holder with attached gripping devices occurs in discrete steps, following the attachment according to step (h).

6. The method of claim 1 in which a plurality of needles are provided, each of said needles being inserted into and stuck or passed through the stack from the bottom of the stack and in a generally vertical direction, the needle points piercing the upper side of the top flat sheet of material immediately behind or next to an attached clamping jaw, a lifting track being provided, said lifting track being guided and inserted between the top flat sheet of material and the adjacent next lower sheet of material, after step (i), so that said lifting track when fully inserted covers the needle points.

7. The method of claim 1 in which each of the pointed tip members is of semi-pyramidal form.

8. A gripping device for gripping a top flat sheet of material from the top of a stack of a plurality of flat sheets of material, so that said top flat sheet of material can be separated from said stack and transported away from said stack, said top flat sheet of material having an upper surface structure which permits the piercing of said upper surface structure by pointed tip members, said gripping device comprising a piston rod, actuation means to displace said piston rod substantially vertically upwards and downwards, said piston rod having a dependent conical base with a planar bottom which is divided, so as to form two opposed built-in clamping jaws at the planar bottom of the conical base, said two clamping jaws being expandable and displaceable away from each other, an expanding spring, said expanding spring being mounted in said conical base between said clamping jaws, so as to bias said clamping jaws towards an expanded and open position, each of said clamping jaws having a row of pointed tip members disposed on the edge of the aperture between said clamping jaws, said two rows of pointed tip members being substantially parallel to each other, each of said pointed tip members depending substantially perpendicularly from the planar bottom of said conical base, and means to bias and displace said clamping jaws towards a contracted and closed position, the means to bias and displace the clamping jaws towards a contracted and closed position comprises a piston guide for the holding and guidance of a working piston, said working piston comprising the actuation means to displace the piston rod, the piston rod being connected to said working piston, said piston guide having a conical opening at its lower base side, said conical opening being coaxially disposed above the conical base, so that when the piston rod is displaced upwards, the conical surface of the conical base slidingly fits into said conical opening, and the clamping jaws are urged towards a contracted and closed position, said piston guide being axially movable, and elastically or spring mounted in a gripper housing, the gripping device being disposed in said gripper housing.

9. The device of claim 8 in which the top flat sheet of material is a textile sheet.

10. The device of claim 8 in which each of the pointed tip members is of semi-pyramidal form.

11. The device of claim 8 in which a second piston is provided in the gripper housing, said second piston being connected with a toothed rack within the gripper housing and forming a unit with a gear wheel to which a finger gripper is mounted, said finger gripper being perpendicular to the gripper housing when in a resting position, and when being rotated to a rotation of 90°, after actuation of said second piston, said finger gripper then lying against the planar bottom side of the pair of gripping jaws located adjacent the side of said finger gripper.

12. The device of claim 8 in which a first generally cylindrical bushing is coaxially mounted in the gripper housing and within the piston guide, said first bushing depending from the working piston and extending to a lower mounting within the piston guide, said first bushing being interchangeable with a second generally cylindrical bushing having a different axial dimension and length measurement, so that the aperture width between the clamping jaws can be varied and changed, by substituting said second bushing for said first bushing.

13. A method for gripping a top flat sheet of material from the top of a stack of a plurality of flat sheets of material, separating said top flat sheet of material from said stack, and transporting said top flat sheet of material away from said stack, said top flat sheet of material having an upper surface structure which permits the piercing of said upper surface structure by pointed tip members, which comprises (a) providing a plurality of spaced-apart gripping devices, said gripping devices being juxtaposed and substantially vertically oriented, and being mounted and dependent from a vertically movable substantally horizontal holder at varying vertical elevations so that the gripping devices are at varying and different distances from the upper surface structure of the top flat sheet of material, said holder being capable of being positioned directly above said stack, so that the lower terminal end of each of said gripping devices is contiguous with said upper surface structure;

(b) providing a pair of opposed built-in clamping jaws at the lower terminal end of each of said gripping devices, said clamping jaws being displaceable and movable towards or away from each other;

(c) providing a plurality of rows of pointed tip members, each row of pointed tip members being dependent from one of said clamping jaws, each pair of rows of pointed tip members being arranged in parallel and disposed at and along the edges of the aperture between the pair of clamping jaws from which they depend, each of said pointed tip members extending substantially perpendicularly downwards from the bottom of its respective clamping jaw;

(d) providing actuation means for the manipulation of said gripping devices;

(e) positioning said holder directly above said stack;

(f) moving the clamping jaws of each of said gripping devices away from each other, so that said clamping jaws are opened;

(g) moving said holder downwards, the varying and different distances of the gripping devices from the upper surface of the top flat sheet being equalized when the holder is moved downwardly because of elastic means mounted in the gripping device, so that said clamping jaws attach onto said top flat sheet of material, with said pointed tip members piercing said upper surface structure without completely penetrating through the structure, or through said top flat sheet of material;

(h) closing said clamping jaws subsequent to the attachment of (g), the closing path and the distance of movement of said clamping jaws being small relative to the dimensions of said upper surface structure, so that said pointed tip members seize and hold only a portion of said top flat sheet of material; and (i) subsequently displacing said holder upwards, so that said top flat sheet of material is lifted off from the top of said stack, with said top flat sheet of material being held by said gripping devices.

14. The method of claim 13 in which the top flat sheet of material is a textile sheet.

15. The method of claim 13 in which the gripping devices alternate between a high and a low vertical elevation, so that the top flat sheet of material assumes an undulating form during movement and lifting from the top of the stack.

16. The method of claim 13 in which the positioning of the holder with attached gripping devices occurs in discrete steps, following the attachment according to step (h).

17. The method of claim 13 in which a plurality of needles are provided, each of said needles being inserted into and stuck or passed through the stack from the bottom of the stack and in a generally vertical direction, the needle points piercing the upper side of the top flat sheet of material immediately behind or next to an attached clamping jaw, a lifting track being provided, said lifting track being guided and inserted between the top flat sheet of material and the adjacent next lower sheet of material, after step (i), so that said lifting track when fully inserted covers the needle points.

18. The method of claim 13 in which each of the pointed tip members is of semi-pyramidal form.

19. A gripping device for gripping a top flat sheet of material from the top of a stack of a plurality of flat sheets of material, so that said top flat sheet of material can be separated from said stack and transported away from said stack, said top flat sheet of material having an upper surface structure which permits the piercing of said upper surface structure by pointed tip members, said gripping device comprising a holder, a plurality of piston rods attached to said holder, said piston rods being mounted on the holder perpendicular thereto at varying vertical elevations so that the piston rods are located at varying and different distances from the upper surface of the flat sheet of material, when picking up the upper sheet, to prevent the subsequent sheet from adhering to the upper sheet, actuation means to displace said piston rods substantially vertically upwards and downwards, each piston rod having a dependent conical base with a planar bottom which is divided, so as to form two opposed built-in clamping jaws at the planar bottom of the conical base, said two clamping jaws being expandable and displaceable away from each other, an expanding spring, said expanding spring being mounted in said conical base between said clamping jaws, so as to bias said clamping jaws towards an expanded and open position, each of said clamping jaws having a row of pointed tip members disposed on the edge of the aperture between said clamping jaws, said two rows of pointed tip members being substantially parallel to each other, each of said pointed tip members depending substantially perpendicularly from the planar bottom of said conical base, and means to bias and displace said clamping jaws towards a contracted and closed position.

20. The device of claim 19 in which the means to bias and displace the clamping jaws towards a contracted and closed position comprises a piston guide for the holding and guidance of a working piston, said working piston comprising the actuation means to displace each piston rod, the piston rod being connected to said working piston, said piston guide having a conical opening at its lower base side, said conical opening being coaxially disposed above the conical base, so that when the piston rod is displaced upwards, the conical surface of the conical base slidingly fits into said conical, opening, and the clamping jaws are urged towards a contracted and closed position.

21. The device of claim 20 in which the piston guide is axially movable, and is elastically or spring mounted in a gripper housing, the gripping device being disposed in said gripper housing.

22. The device of claim 21 in which a second piston is provided in the gripper housing, said second piston being connected with a toothed rack within the gripper housing and forming a unit with a gear wheel to which a finger gripper is mounted, said finger gripper being perpendicular to the gripper housing when in a resting position, and when being rotated to a rotation of 90°, after actuation of said second piston, said finger gripper then lying against the planar bottom side of the pair of gripping jaws located adjacent the side of said finger gripper.

23. The device of claim 21 in which a first generally cylindrical bushing is coaxially mounted in the gripper housing and within the piston guide, said first bushing depending from the working piston and extending to a lower mounting within the piston guide, said first bushing being interchangeable with a second generally cylindrical bushing having a different axial dimension and length measurement, so that the aperture width between the clamping jaws can be varied and changed, by substituting said second bushing for said first bushing.

* * * * *